US005301576A

United States Patent [19]

Nye

[11] Patent Number: 5,301,576

[45] Date of Patent: Apr. 12, 1994

[54] LOCKING AND CLAMPING ADJUSTABLE WRENCH

[76] Inventor: William J. Nye, 251 Tiffany Ave., Warwick, R.I. 02889-5820

[21] Appl. No.: 24,745

[22] Filed: Mar. 2, 1993

[51] Int. Cl.[5] ..... B25B 13/16

[52] U.S. Cl. ..... 81/165; 81/170

[58] Field of Search ..... 81/157, 165, 170

[56] References Cited

U.S. PATENT DOCUMENTS

| | | | |
|---|---|---|---|
| 2,112,840 | 4/1938 | Haist | 81/165 |
| 2,687,662 | 8/1954 | Pugh | 81/165 |
| 2,813,444 | 11/1957 | Hatch | 81/165 |
| 2,849,908 | 9/1958 | Swanstrom et al. | 81/165 |
| 2,869,409 | 1/1959 | Swanstrom et al. | 81/165 |
| 3,174,366 | 3/1965 | Fujii | 81/165 |

*Primary Examiner*—Robert C. Watson

[57] ABSTRACT

The invention relates to the head of an adjustable wrench. A threaded adjustment mechanism provides the wrench with a clamping and locking capability.

6 Claims, 5 Drawing Sheets

LOCKING AND CLAMPING ADJUSTABLE WRENCH

SUMMARY

The invention combines the functions of the standard adjustable wrench with that of a clamp, and that of a fixed-end wrench. This is achieved by means of the threaded adjustment mechanism, which integrates a screw device into the standard wrench's threaded adjustment mechanism. The invention would be used in the following scenarios:

a) One or more objects need to be held, drilled, soldered, welded or worked on in another manner. The object(s) may be clamped by the wrench and held for this purpose.

b) Several threaded bolts of the same size need to be loosened or tightened. The wrench may be set and locked to the desired gap, eliminating the need to re-check for correct adjustment if the tool is temporarily set aside.

c) A threaded bolt needs to be removed, but is on too tight or frozen and needs to be loosened with the aid of a rubber mallet. The wrench can be clamped to the bolt. The shock from the impact of the mallet on the wrench handle is transmitted more effectively than the relatively loose fit of the standard wrench would allow, and helps eliminate accidental rounding of the hex faces.

DISCUSSION OF DRAWINGS

Item 1—Wrench head/body/handle/upper jaw, with threaded hole to accept item 4

Item 2—Thumb adjuster.

Item 3—Retainer washer.

Item 4—Adjuster pin. Consists of (from one end to the other) a round shaft, a groove in the shaft for the retainer washer, a shoulder upon which one face of the retainer washer rests, threads, stem, and a serrated knob with a hex-type recess.

Item 5—Movable lower jaw.

Item 6—Spring.

Figure 2:
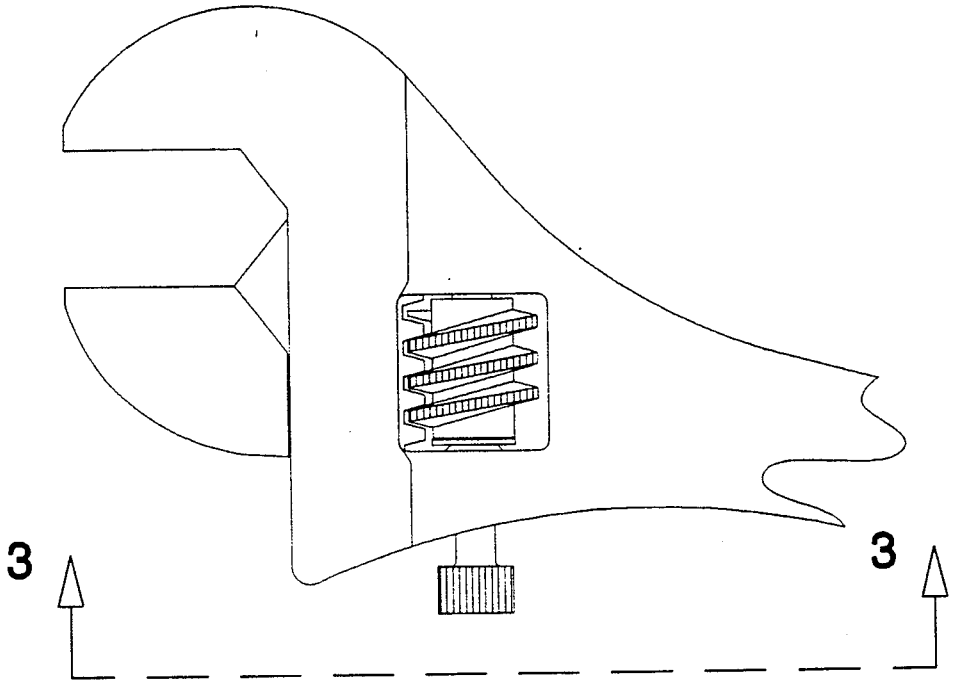
FIG. 2 is an enlarged side view of the wrench head.
Figure 1:
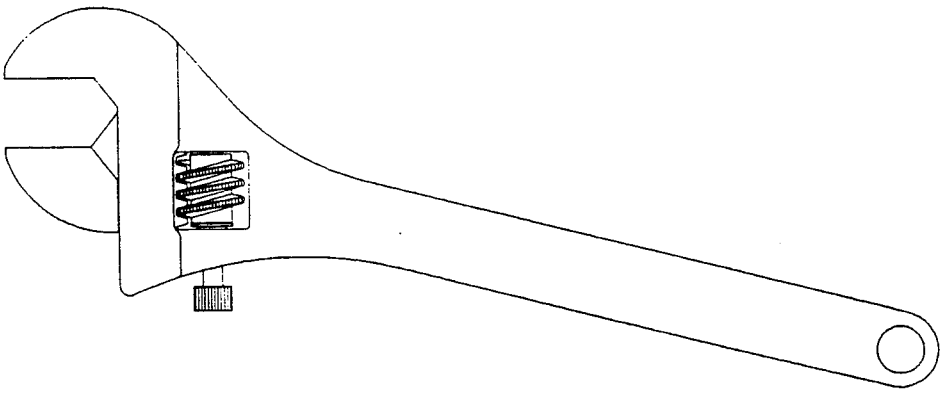
FIG. 1 is a side view of the locking adjustable wrench.
Figure 4:
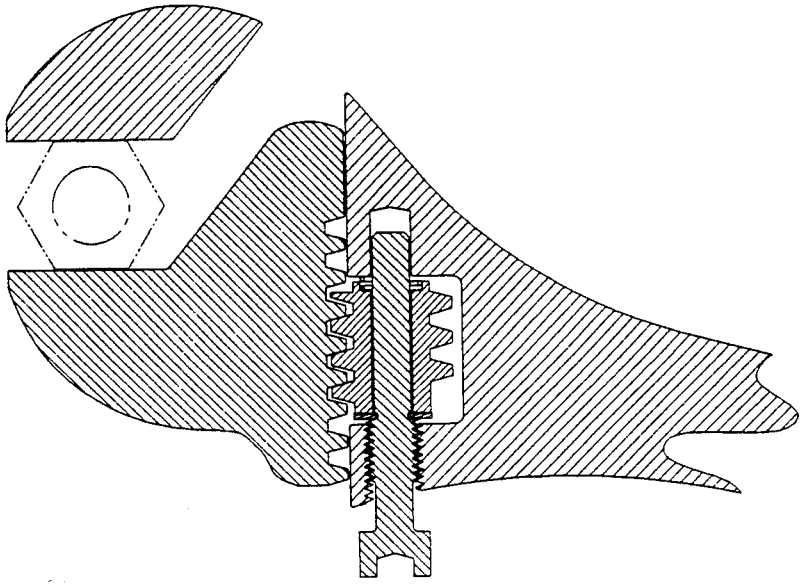
FIG. 4 shows a section cut through the wrench head.
Figure 3:
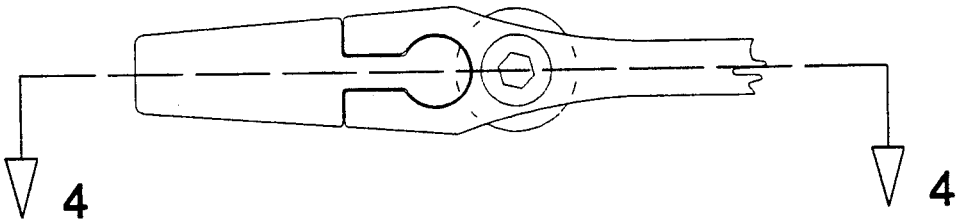
FIG. 3 shows a bottom view of the wrench head.
Figure 6:
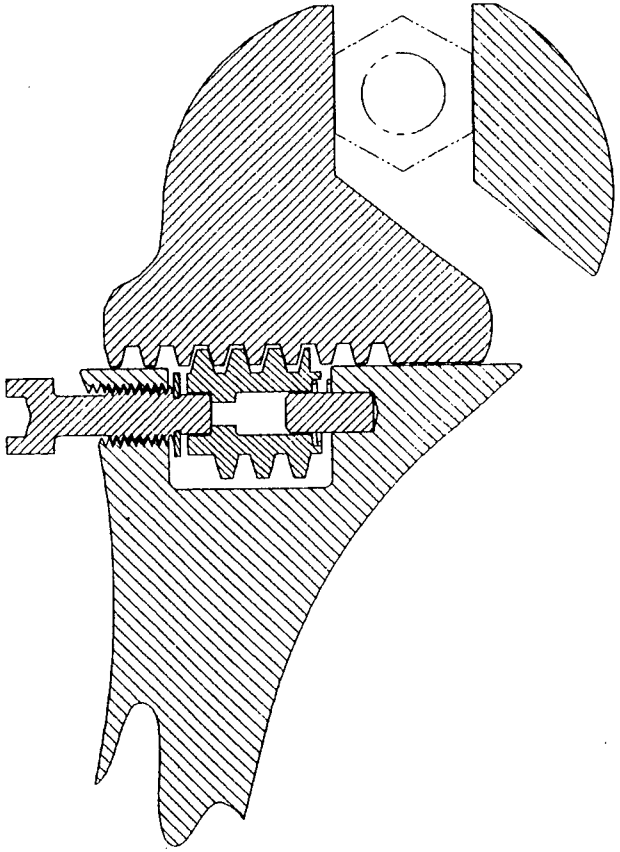

FIG. 6 shows a section cut taken from the same plane as FIG. 4. An alternate configuration is shown.

Figure 7:
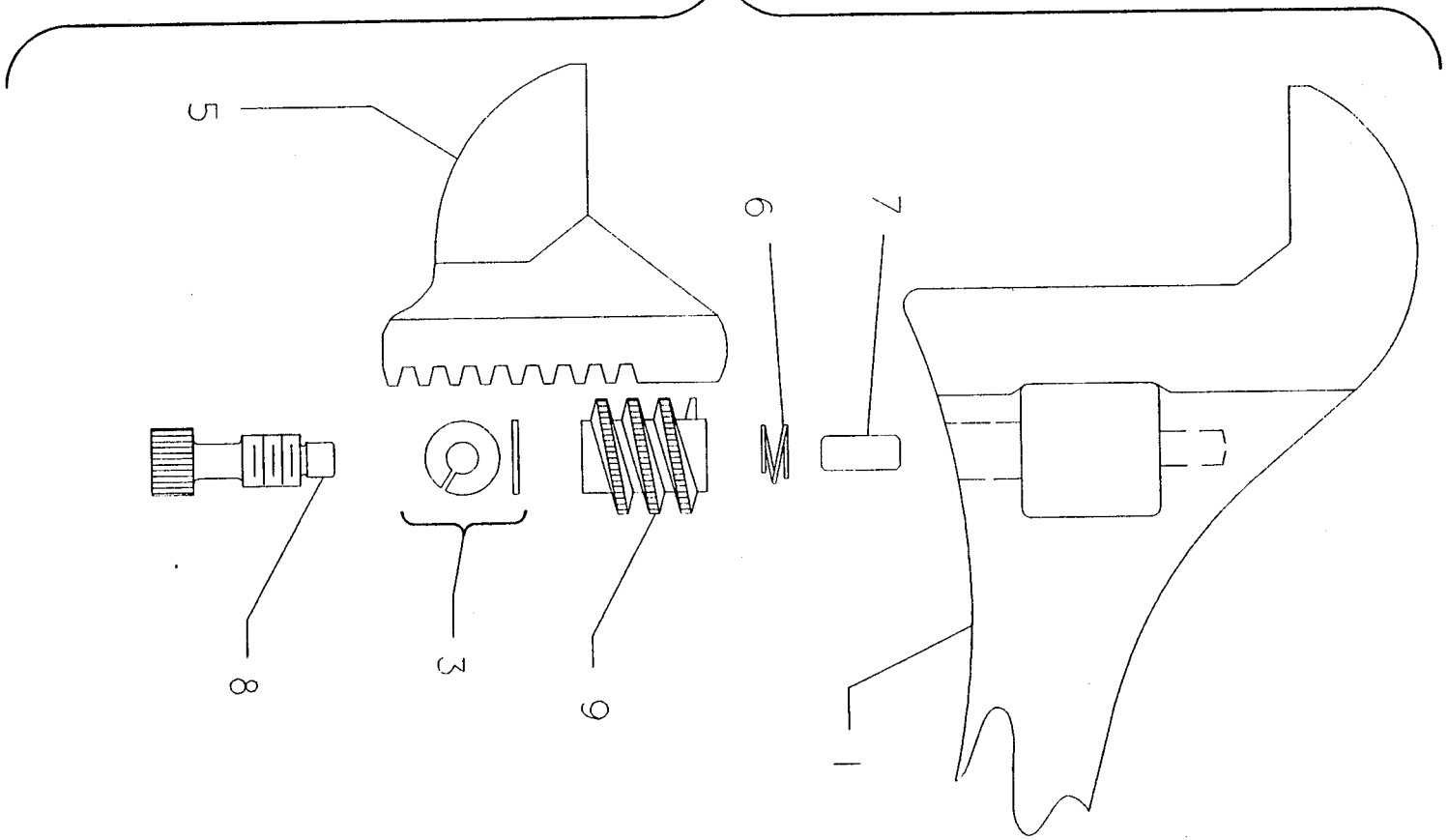

FIG. 7 shows an exploded view of the threaded adjustment assembly of FIG. 6. The following items are shown:

Item 1—Wrench head/body/handle/upper jaw, with threaded hole to accept item 8

Item 3—Retainer washer.

Item 5—Movable lower jaw.

Item 6—Spring.

Item 7—Dowel pin.

Item 8—Adjuster pin, Consists of (from one end to the other) a round shaft, a groove in the shaft for the retainer washer, a shoulder upon which one face of the retainer washer rests, threads, stem, and a serrated knob with a hex-type recess.

Item 9—Thumb adjuster.

DETAILED DESCRIPTION

Figure 5:
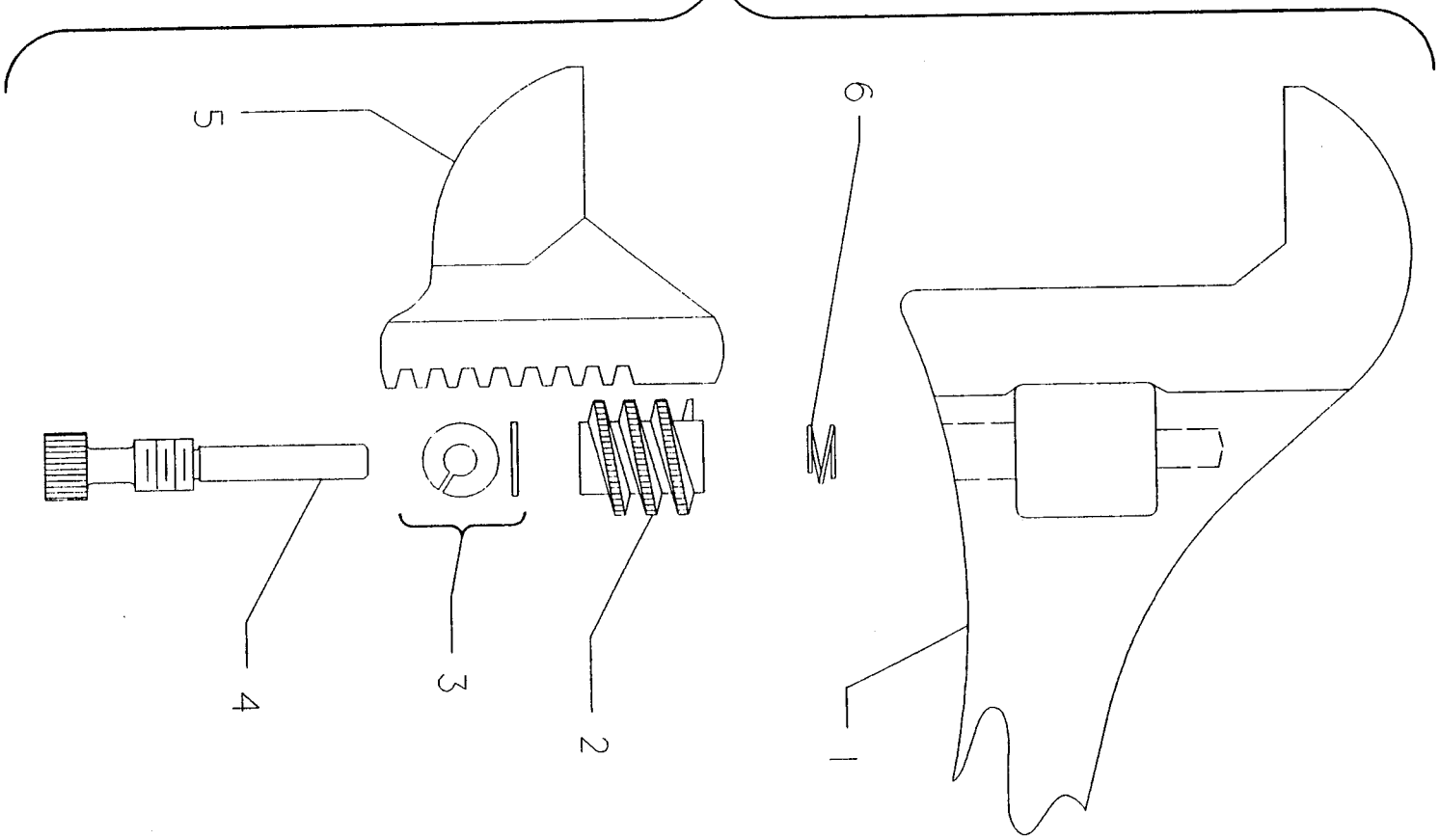
FIG. 5 shows an exploded view of the threaded adjustment assembly of FIG. 4. The following items are shown.

The invention is based on a modified design of the existing standard adjustable wrench. The standard adjustable wrench is capable of varying the space between it jaws to match the size of the foreign object it will hold, allowing the user to apply torque to the object. This is accomplished with a threaded adjustment mechanism, which operates as follows. References to the components in FIG. 5 are used where general similarities permit. The standard wrench's upper jaw 1 is fixed and is integral with the tool's handle. A movable lower jaw 5 is positioned by a rotating externally threaded member, thumb adjuster 2. Thumb adjuster 2 is held in place by a dowel pin or shaft, upon which thumb adjuster 2 turns freely. External ACME or other configured threads on thumb adjuster 2 engage rack-type mating threads on lower jaw 5, converting the rotation of thumb adjuster 2 into linear motion of lower jaw 5. Thumb adjuster 2 rotates clockwise or counter-clockwise without restriction, unless lower jaw 5 has reached the limits of travel. Limits of travel consist of full open and full closed. The full open condition is typically imposed by the length of the rack-type threading on lower jaw 5. The full closed condition is typically imposed when lower jaw 5 meets upper jaw 1, or when the upper and lower jaws make contact with opposite faces of a foreign object. When lower jaw 5 has reached a limit of travel, thumb adjuster 2 is free to turn in the direction which would move lower jaw 5 towards the opposite limit of travel.

The invention replaces the dowel pin or shaft with a screw device, adjuster pin 4, resulting in the threaded adjustment assembly shown in FIG. 5. Adjuster pin 4 combines the function of the dowel pin or shaft of the standard wrench, and that of a screw device, in one component. A screw device is defined as a device which converts rotation into linear motion. Adjuster pin 4 provides a physical axis of rotation for thumb adjuster 2, and also releasably engages thumb adjuster 2 at the thumb adjuster's base with compressive force. The compressive force is transmitted through the shoulder at the end of the threaded section of adjuster pin 4, and also through retainer washer 3, for the purpose of inducing friction for creating a locking effect, and for the purpose of inducing axial displacement for creating a clamping effect. The cutout in wrench body 1, which houses thumb adjuster 2, is sized to allow for a limited amount of axial displacement of thumb adjuster 2. Retainer washer 3 and spring 6 are enhancements to the functionality of the assembly. Retainer washer 3 prevents adjuster pin 4 from being easily removed from the tool, and spring 6 reduces slop in the axial movement of thumb adjuster 2.

Adjuster pin 4 may be rotated in a direction which backs it out of wrench body 1, until retainer washer 3 engages wrench body 1 and prevents further rotation. In this mode the invention functions as a standard adjustable wrench, as described above. Thumb adjuster 2 may be rotated freely to set the desired lower jaw 5 position.

To lock lower jaw 5 to a desired position, adjuster pin 4 may be rotated in the direction which causes the compression of spring 6, and tightened, such that the resulting friction between wrench body 1, thumb adjuster 2, retaining washer 3 and adjuster pin 4 prevents further rotation of thumb adjuster 2.

To use the invention as a clamp, adjuster pin 4 is rotated in a direction which backs it out of wrench body 1, until retainer washer 3 engages wrench body 1 and prevents further rotation. The wrench can be fit to a foreign object(s) using thumb adjuster 2. Clamping force is then generated by tightening adjuster pin 4. This axially displaces thumb adjuster 2, and lower jaw 5 to which it is engaged, in a direction which tends to reduce the gap between the jaws. Total allowable compressive displacement of the clamped foreign object is limited to the pre-load gap between the end of thumb adjuster 2 (at end where spring 6 is located) and cutout boundary in wrench body 1.

The hand of the external threads (right hand vs. left hand) on thumb adjuster 2 and adjuster pin 4 is coordinated such that when adjuster pin 4 is being tightened as discussed above and is generating clamping force, the resulting frictional torque from adjuster pin 4 acting on thumb adjuster 2 will tend to incrementally rotate thumb adjuster 2 in the same direction, which rotational direction shall correspond to that required to close the jaws.

Although one detailed embodiment of the invention is previously described in detail, this invention contemplates any configuration and design of components which will accomplish the equivalent result. As an example, an alternate configuration is shown in FIGS. 6 and 7. A dowel pin 7 is added, which differs from the dowel pin or shaft of the standard adjustable wrench primarily in that it does not extend all the way through thumb adjuster 9, and is attached at one end only to wrench body 1. Thumb adjuster 9 and adjuster pin 8 are revised from the FIG. 4 version in that adjuster pin 8, when tightened, applies compressive force on a shoulder inside the center hole of thumb adjuster 9.

What is claimed is:

1. An adjustable wrench comprising a fixed upper jaw, a handle, a movable lower jaw slidably mounted on a wrench body, said wrench body having a threaded opening and cutout, said threaded opening having its axis disposed in the direction of travel of the movable jaw, a thumb adjuster coaxially aligned with said threaded opening axis and mounted within said cutout and having threaded engagement with said movable jaw, said cutout sized to provide a gap between itself and said thumb adjuster to allow for a limited amount of axial displacement of said thumb adjuster, and having a surface at one end which is engagable with said thumb adjuster and a surface at the opposite end which is engagable with a retainer washer, said thumb adjuster journaled on an adjuster pin and having a surface at one end which is engagable with said surface of said cutout and a surface at the opposite end which cooperates via said retainer washer with a shoulder on said adjuster pin, said retainer washer sandwiched by both the cooperating shoulder surface of said adjuster pin and the cooperating surface of said thumb adjuster, said adjuster pin loosely received at one end in said wrench body, said adjuster pin having said end and adjacent midsection formed as a shaft, a groove which holds said retainer washer, a shoulder surface normal to said threaded opening axis which cooperates with said surface on said thumb adjuster, a threaded portion which is received by said threaded opening, and a knob at the outer end.

2. A wrench as set forth in claim 1 wherein the knob on the adjuster pin has a feature for attaching a supplementary tool.

3. A wrench as set forth in claim 1 wherein the threads on the adjuster pin and the thumb adjuster are of opposite hand configuration.

4. An adjustable wrench comprising a fixed upper jaw, a handle, a movable lower jaw slidably mounted on a wrench body, said wrench body having a threaded opening and cutout, said threaded opening having its axis disposed in the direction of travel of the movable jaw, a thumb adjuster coaxially aligned with said threaded opening axis and mounted within said cutout and having threaded engagement with said movable jaw, said cutout sized to provide a gap between itself and said thumb adjuster to allow for a limited amount of axial displacement of said thumb adjuster, and having a surface at one end which is engagable with said thumb adjuster and a surface at the opposite end which is engagable with a retainer washer, said thumb adjuster having a central bore which is journaled at one end by a partially inserted dowel pin and at the other end by a partially inserted adjuster pin, said central bore having an internally formed 90 degree shoulder which cooperates with the end face of said adjuster pin, said dowel pin snugly received in said wrench body and coaxially aligned with said threaded opening axis, said adjuster pin having an end section formed as a shaft, a groove which holds said retainer washer, a threaded portion which is received by said threaded opening, and a knob at the outer end.

5. A wrench as set forth in claim 4 wherein the knob on the adjuster pin has a feature for attaching a supplementary tool.

6. A wrench as set forth in claim 4 wherein the threads on the adjuster pin and the thumb adjuster are of opposite hand configuration.

* * * * *